US006225736B1

(12) United States Patent
Gorog

(10) Patent No.: US 6,225,736 B1
(45) Date of Patent: May 1, 2001

(54) COLOR PICTURE TUBE HAVING A LOW EXPANSION TENSION MASK ATTACHED TO A HIGHER EXPANSION FRAME

(75) Inventor: Istvan Gorog, Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/283,508

(22) Filed: Apr. 1, 1999

(51) Int. Cl.[7] ..... H01J 29/80
(52) U.S. Cl. ..... 313/407; 313/402
(58) Field of Search ..... 313/402, 403, 313/404, 405, 407, 408

(56) References Cited

U.S. PATENT DOCUMENTS

| | | | |
|---|---|---|---|
| 3,573,528 | 4/1971 | Maeda | 313/85 |
| 4,973,283 | 11/1990 | Adler et al. | 445/30 |
| 5,488,263 | 1/1996 | Takemura et al. | 313/402 |

FOREIGN PATENT DOCUMENTS

| | | | |
|---|---|---|---|
| 0602620A1 | 6/1994 | (EP) | H01J/29/07 |
| 0788132A2 | 8/1997 | (EP) | H01J/29/07 |
| 2308223 | 6/1997 | (GB) . | |
| 2311165 | 9/1997 | (GB) . | |
| 59-203349 | 11/1984 | (JP) | H01J/29/07 |

OTHER PUBLICATIONS

Patent Abstract of Japan, vol. 009, No. 065 (E–304), Mar. 26, 1985 & (Toshiba KK).

*Primary Examiner*—Vip Patel
(74) *Attorney, Agent, or Firm*—Joseph S. Tripoli; Dennis H. Irlbeck

(57) ABSTRACT

A color picture tube has a tensioned mask supported by a support frame mounted within the tube. The mask has a significantly lower coefficient of thermal expansion than the frame. The mask has an active apertured portion formed by a plurality of parallel vertically extending strands, through which electron beams pass during operation of the tube, and two opposite side border portions outside the active apertured portion. The two opposite side border portions have tie bars that extend between the vertical strands of the mask. The tie bars accommodate expansion of the frame, while substantially maintaining the positions of the vertical strands in the active portion of the mask.

10 Claims, 6 Drawing Sheets

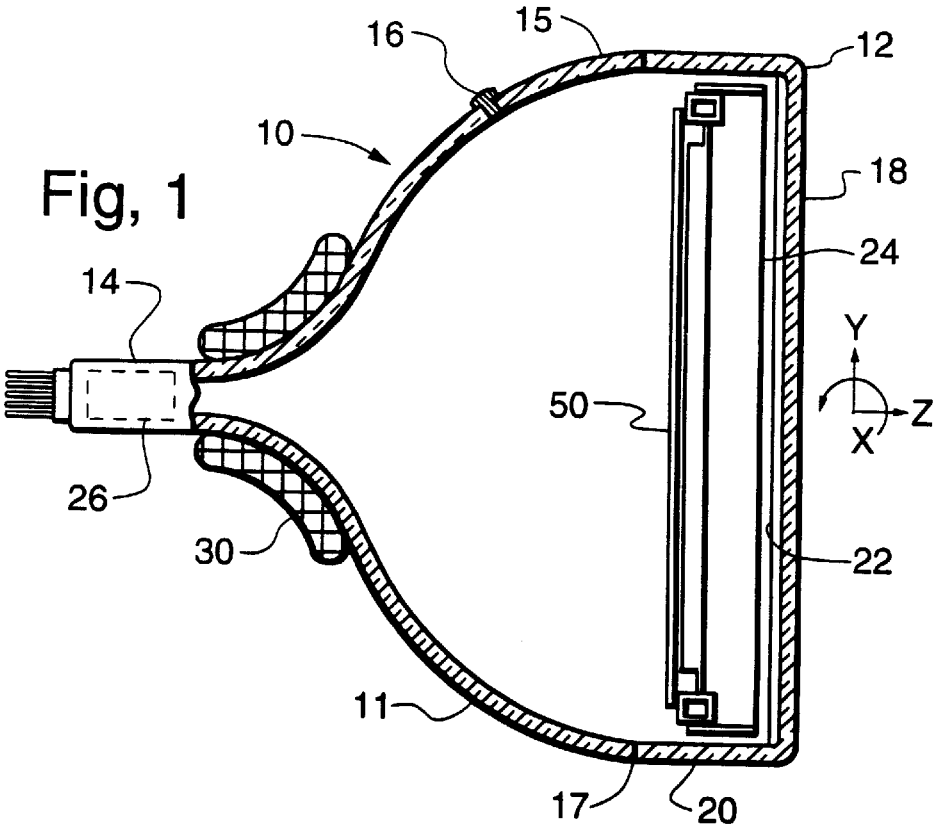
Fig, 1
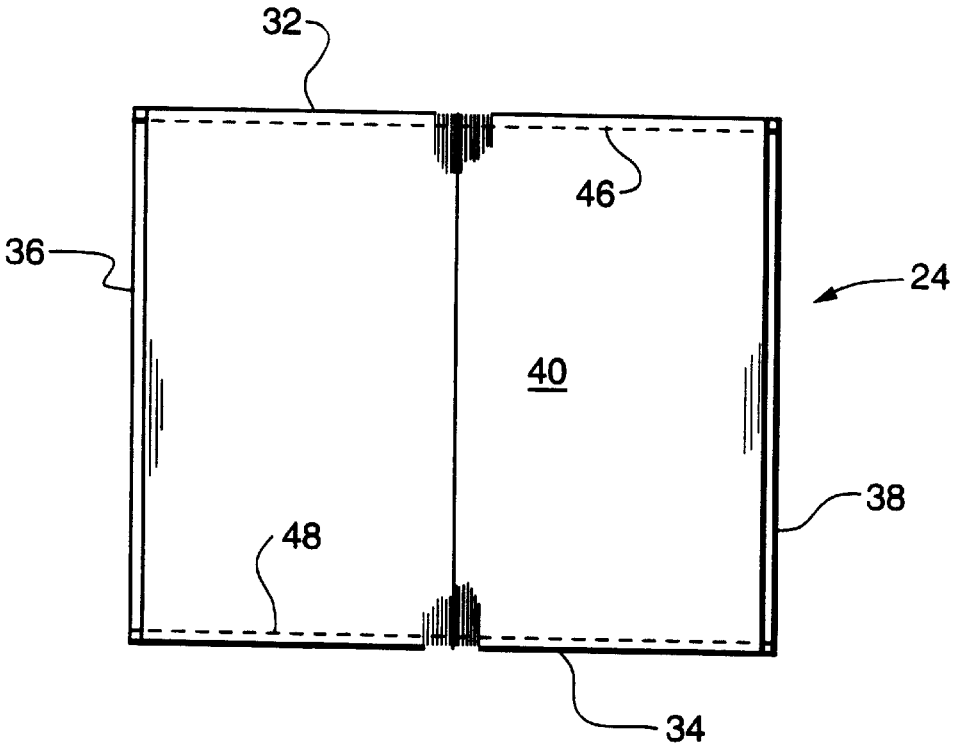
Fig. 2

COLOR PICTURE TUBE HAVING A LOW EXPANSION TENSION MASK ATTACHED TO A HIGHER EXPANSION FRAME

This invention relates to color picture tubes having tension masks, and particularly to a tube having means for connecting a tension mask, that is made of a material having a relatively low coefficient of thermal expansion material, to a support frame, that has a significantly higher coefficient of thermal expansion.

BACKGROUND OF THE INVENTION

A color picture tube includes an electron gun for generating and directing three electron beams to the screen of the tube. The screen is located on the inner surface of a faceplate of the tube and is made up of an array of elements of three different color emitting phosphors. A color selection electrode, which may be either a shadow mask or a focus mask, is interposed between the gun and the screen to permit each electron beam to strike only the phosphor elements associated with that beam. A shadow mask is a thin sheet of metal, such as steel, that is usually contoured to somewhat parallel the inner surface of the tube faceplate.

One type of color picture tube has a tensioned shadow mask mounted within a faceplate panel thereof. In order to maintain the tension on the mask, the mask must be attached to a relatively massive support frame. Although such tubes have found wide consumer acceptance, there is still a need for further improvement in tube types to reduce the weight and cost of the mask-frame assemblies in such tubes.

It has been suggested that a lighter frame could be used in a tension mask tube if the required tension on a mask is reduced. One way to reduce the required mask tension is to make the mask from a material having a low coefficient of thermal expansion. However, a mask from such material would require a support frame of a material having a similar coefficient of thermal expansion to prevent any mismatch of expansions during thermal processing that is required for tube manufacturing, and during tube operation. Because the metal materials that have low coefficients of thermal expansion are relatively expensive, it is relatively costly to make both the mask and frame out of identical or similar materials. Therefore, it is desirable to use the combination of a low expansion tension mask with a higher expansion support frame. The present invention provides a solution to the problem that exists when there is a substantial mismatch in coefficients of thermal expansion between a tension mask and its support frame.

SUMMARY OF THE INVENTION

The present invention provides an improvement in a color picture tube having a tension mask supported by a support frame mounted within the tube. The tension mask has a significantly lower coefficient of thermal expansion than that of the frame. The mask includes an active apertured portion formed by a plurality of parallel vertically extending strands, between which are elongated apertures through which electron beams pass during operation of the tube. Two opposite side border portions, outside the active apertured portion, have tie bars that extend between the vertical strands of the mask. The tie bars accommodate expansion of the frame, while substantially maintaining the positions of the vertical strands in the active portion of the mask.

BRIEF DESCRIPTION OF THE DRAWINGS

FIG. 1 is a side view, partly in axial section, of a color picture tube embodying the invention.

FIG. 2 is a front view of a tension shadow mask.

DETAILED DESCRIPTION OF THE PREFERRED EMBODIMENTS

Figure 3:
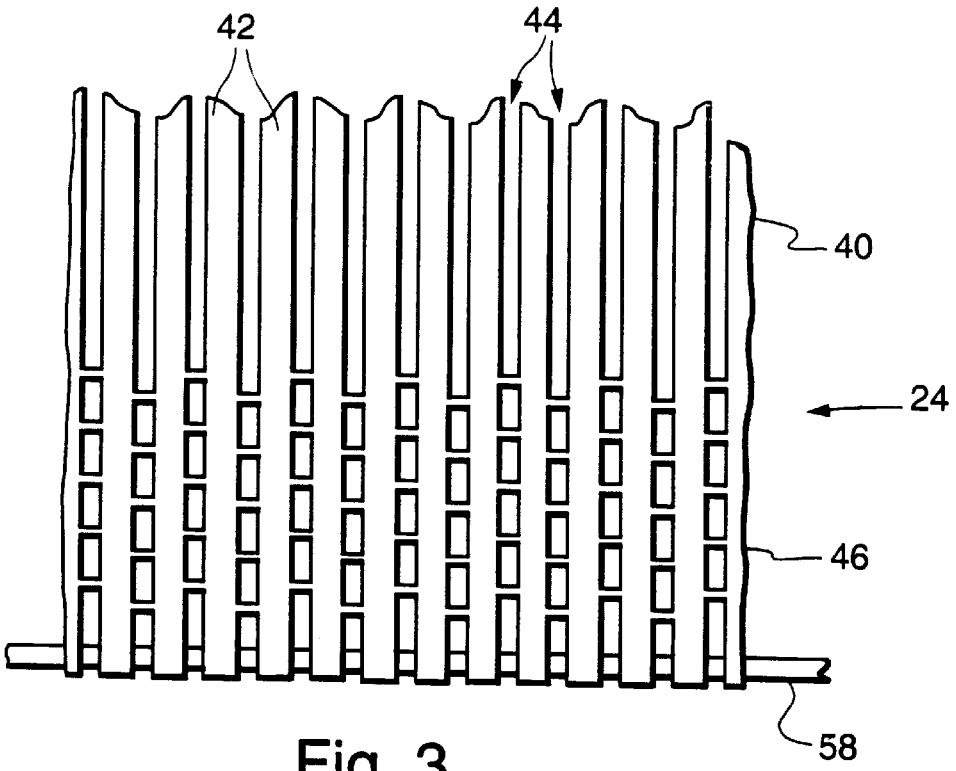
FIG. 3 is a front view of a small section of a border portion of the mask of FIG. 2.

FIG. 1 shows a color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the wide portion of the funnel and to the neck 14. The panel 12 comprises a substantially flat external viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A color selection tension shadow mask 24 is removably mounted in predetermined spaced relation to the screen 22. An electron gun 26, shown schematically by dashed lines in FIG. 1, is centrally mounted within the neck 14 to generate and direct three inline electron beams, a center beam and two side beams, along convergent paths through the mask 24 to the screen 22.

The tube 10 is designed to be used with an external magnetic deflection yoke, such as the yoke 30 shown in the neighborhood of the funnel-to-neck junction. When activated, the yoke 30 subjects the three beams to magnetic fields which cause the beams to scan horizontally and vertically in a rectangular raster over the screen 22.

The tension shadow mask 24, shown in FIGS. 2 and 3, includes two long sides 32 and 34, and two short sides 36 and 38. The two long sides 32 and 34 of the mask parallel a central major axis, X, of the mask; and the two short sides 36 and 38 parallel a central minor axis, Y, of the mask. The tension shadow mask 24 includes an active apertured portion 40 that contains a plurality of parallel vertically extending strands 42. A multiplicity of elongated apertures 44, between the strands 42, parallel the minor axis Y of the mask. The electron beams pass through the apertures 44 in the active portion 40 during tube operation. Each aperture 44 extends continuously from a border portion 46 at a long side 32 of the mask to another border portion 48 at the opposite long side 34.

Figure 4:
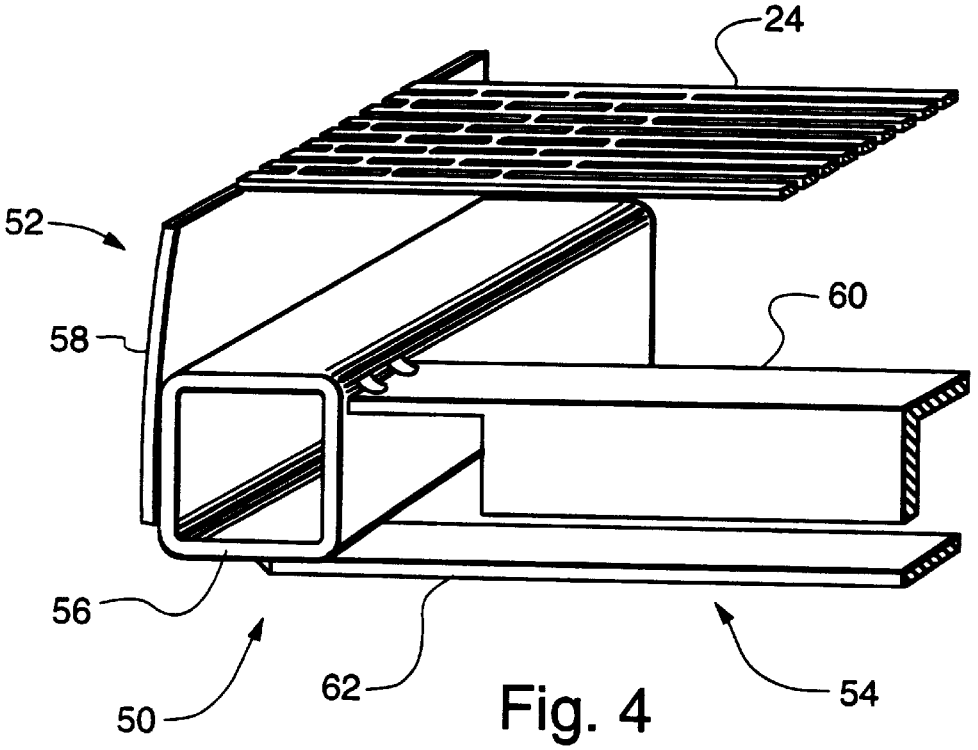
FIG. 4 is a perspective view of a corner of a tension shadow mask-frame assembly.
Figure 5:
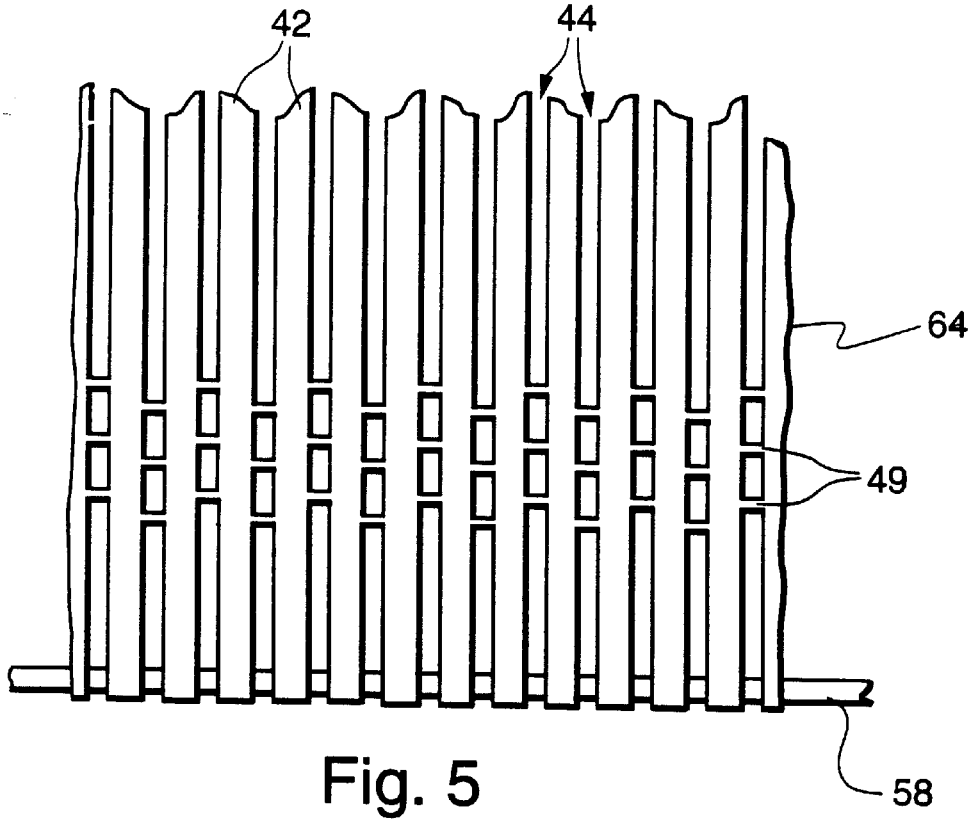
FIGS. 5 through 11 are front views of small sections of six different alternative embodiments of tension mask border portions.
Figure 6:
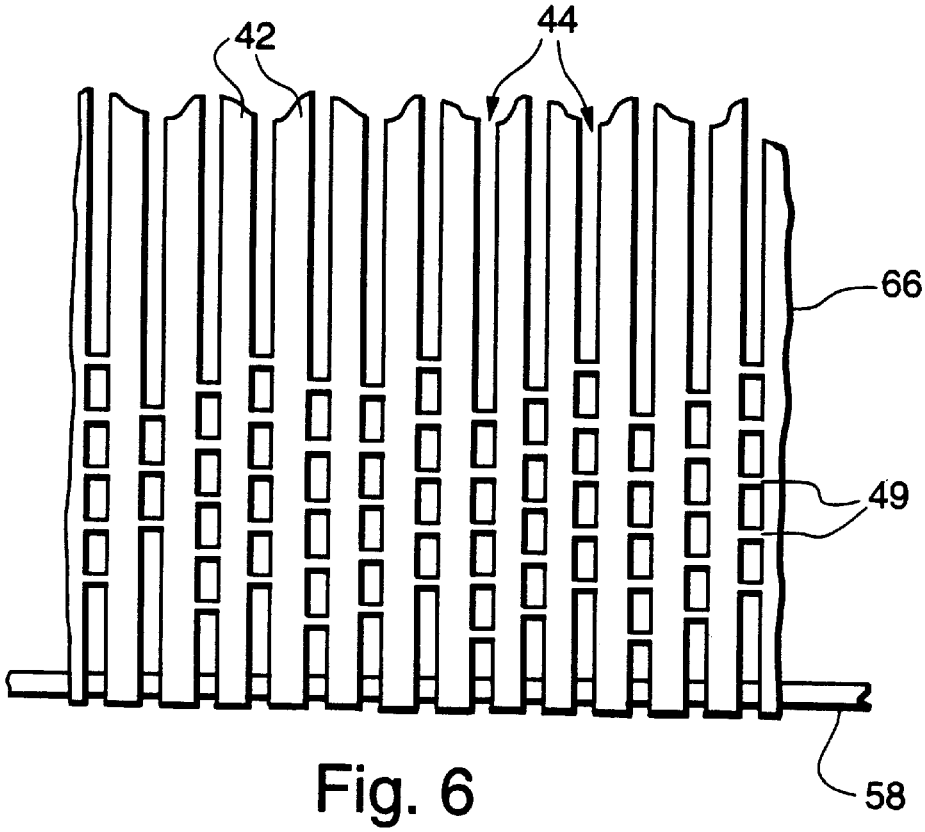

A frame 50, for use with the tension shadow mask 24 is partially shown in FIG. 4. The frame 50 includes four sides: two long sides 52, substantially paralleling the major axis X of the tube, and two short sides 54, paralleling the minor axis Y of the tube. Each of the two long sides 52 includes a rigid section 56 and a compliant section 58 cantilevered from the rigid section. The rigid sections 56 are hollow tubes, and the compliant sections 58 are metal plates. Each of the short sides 54 has an L-shaped cross-section upper portion 60 parallel to and separated from a flat bar-shaped lower portion 62. The two long sides 32 and 34 of the tension mask 24 are welded to the distal ends of the compliant sections 58. Although the present invention is described in embodiments using the frame 50, it is to be understood that many other types of tension frames could also be used with the present invention.

The strands 42 are continued from the active portion 40 into the border portions 46 and 48, where they are connected by tie bars 49, which interrupt the continuation of the apertures 44, as shown in FIGS. 3 through 10. The tie bars 49 in adjacent columns are vertically offset from each other, so that no two tie bars in adjacent columns have horizontally aligned centerlines. The strands 42 also extend beyond the border portions 46 and 48, where they are individually welded to the frame.

The purpose of the tie bars 49 in the border portions 46 and 48 of the mask 24 is two-fold. First, the tie bars 49 accommodate undesirable strand positioning errors that occur when individual strands are welded to the compliant section 58. Such individual strand attachment is required to avoid inelastic deformations that would be produced during thermal processing of mask-frame systems, wherein the mask and frame have considerably different coefficients of thermal expansion and the mask has a solid border in the weld zone, as is known in the art. When a low-thermal expansion mask with a solid border is affixed to a high-thermal expansion compliant section 58, thermal processing of the tube, which can reach temperatures as high as 450° C., can cause the mask to be inelastically stretched in the solid border region, and upon cool-down the mask wrinkles. In the absence of a solid border region, tie bars 49 assure that the desired strand spacing is maintained during welding.

The second purpose for the tie bars 49 is to accommodate the greater expansion of a high expansion frame 50 compared to that of a low expansion mask 24, without causing appreciable relocation of the mask strands 42 through permanent deformation of the mask border portion. The tie bars 49, together with the strand sections they interconnect, generally achieve this result by elastically stretching near the active portion of the mask. A key objective of all border treatments disclosed herein, wherein masks and frames are constructed of dissimilar materials, is to provide strand-to-strand spacing means when welding individual strands or small groups of strands, such that the mask can withstand the customary thermal processing of the tube without the formation of inelastic deformations that would result in errors in strand-to-strand openings.

Figure 7:
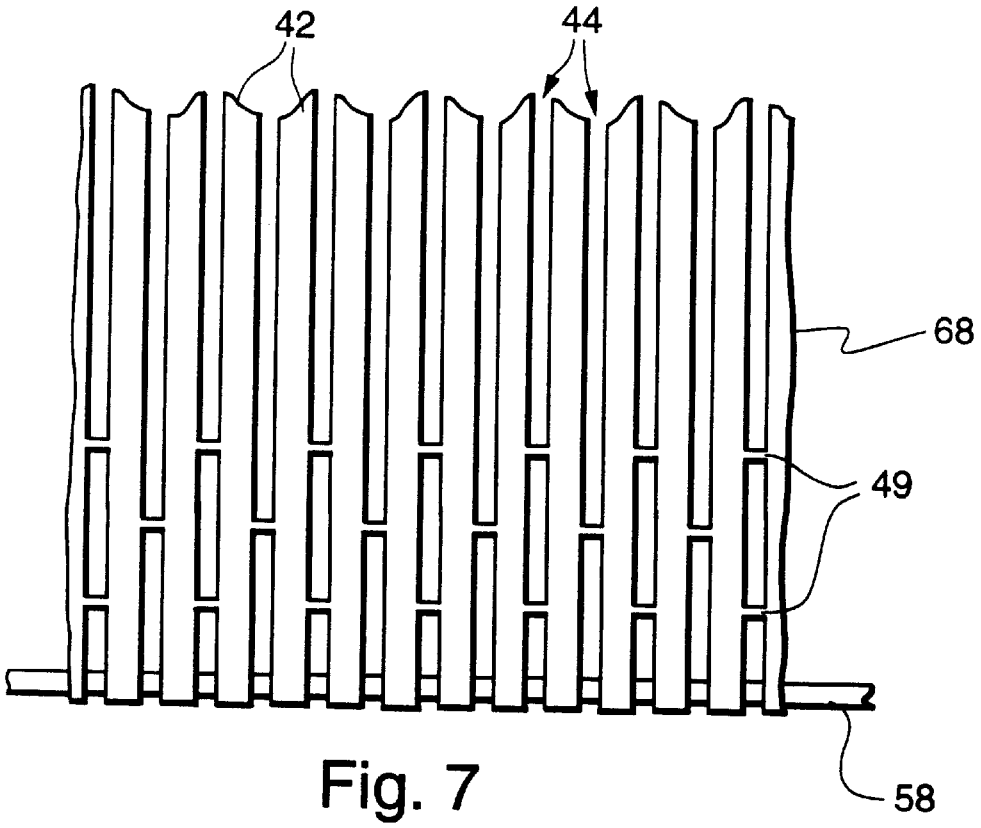
Figure 8:
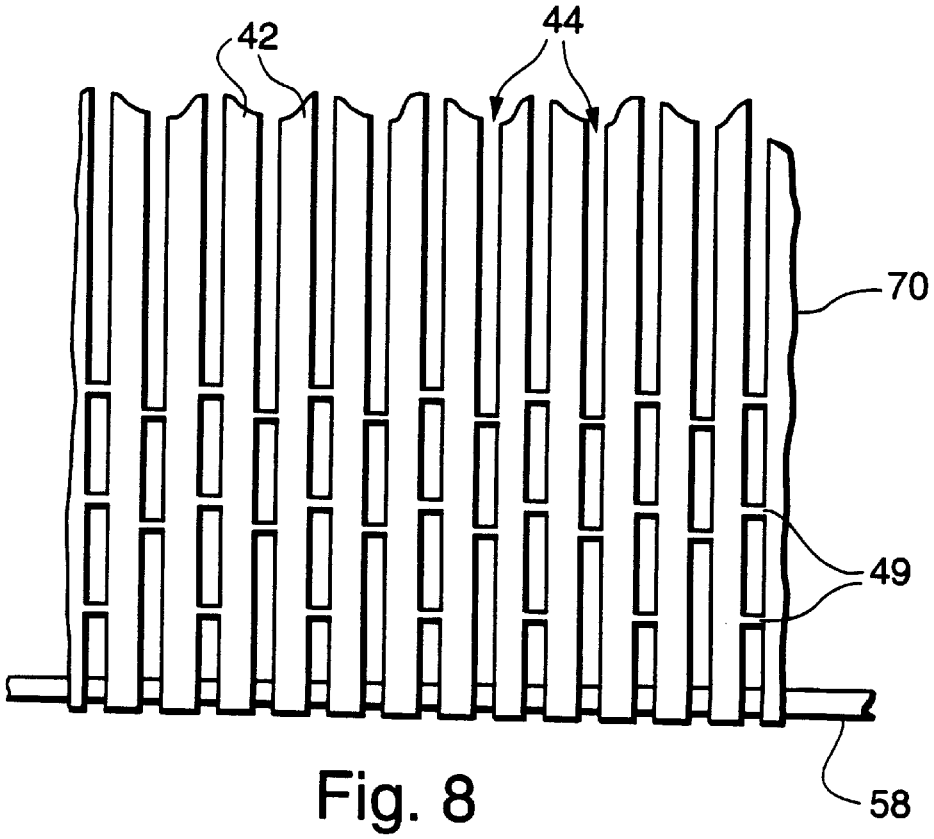
Figure 9:
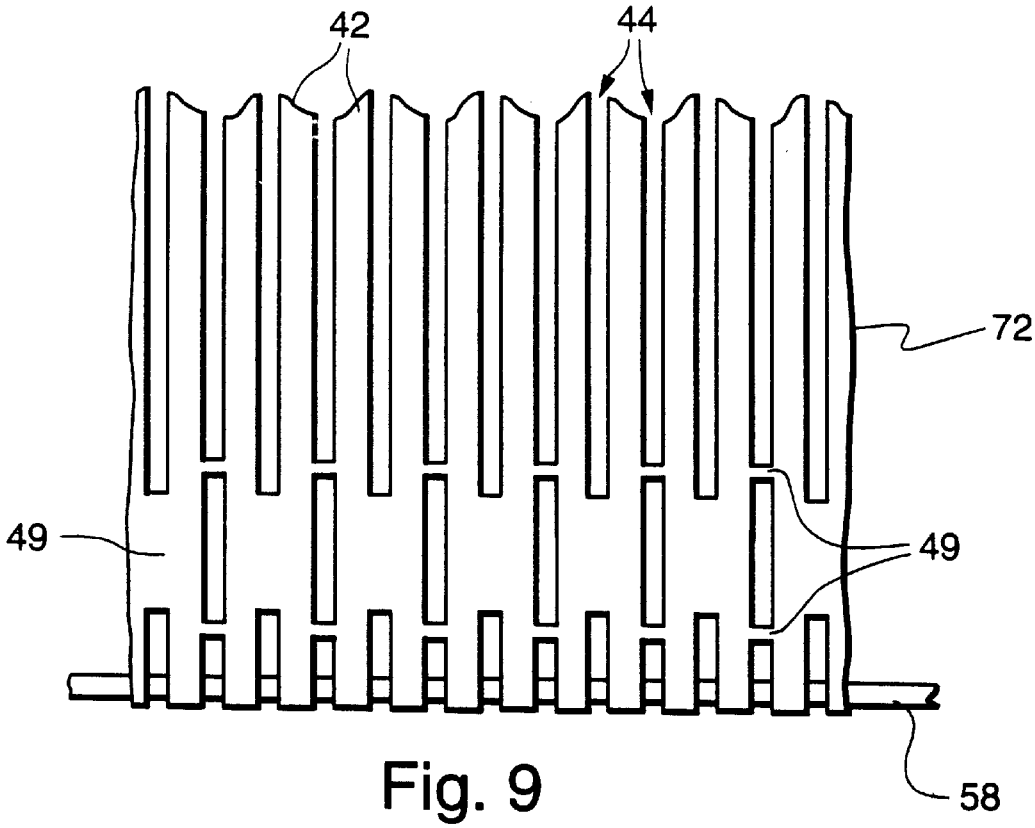
Figure 10:
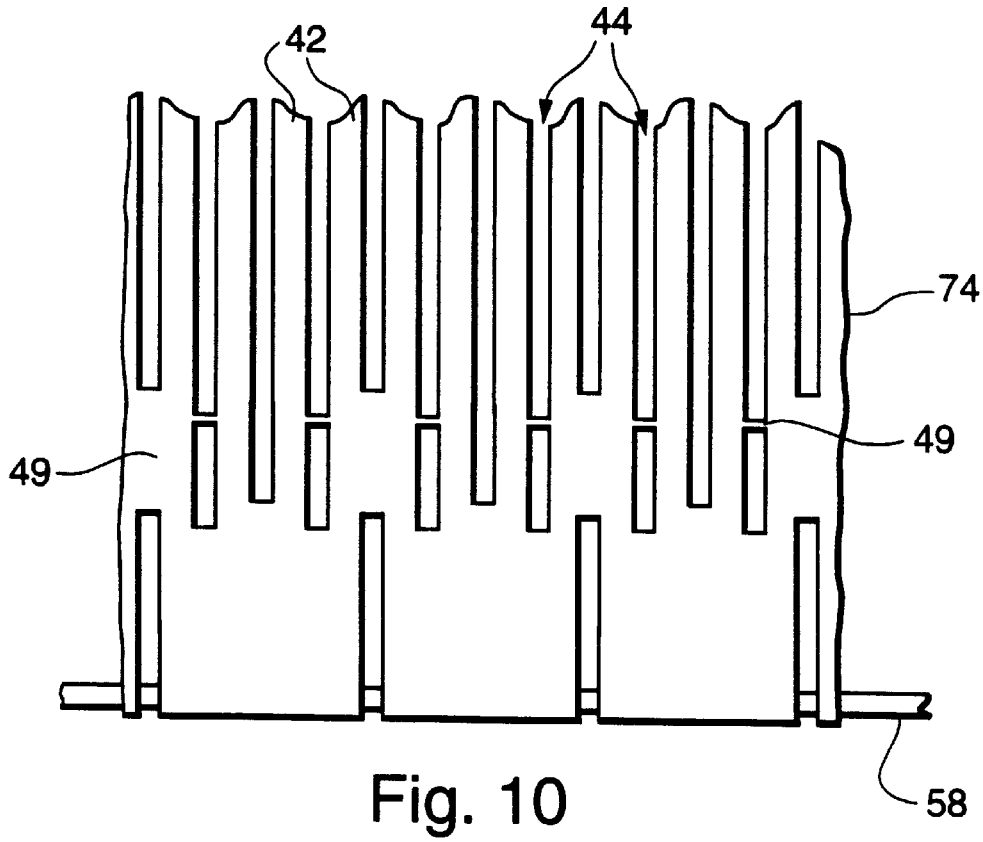
Figure 11:
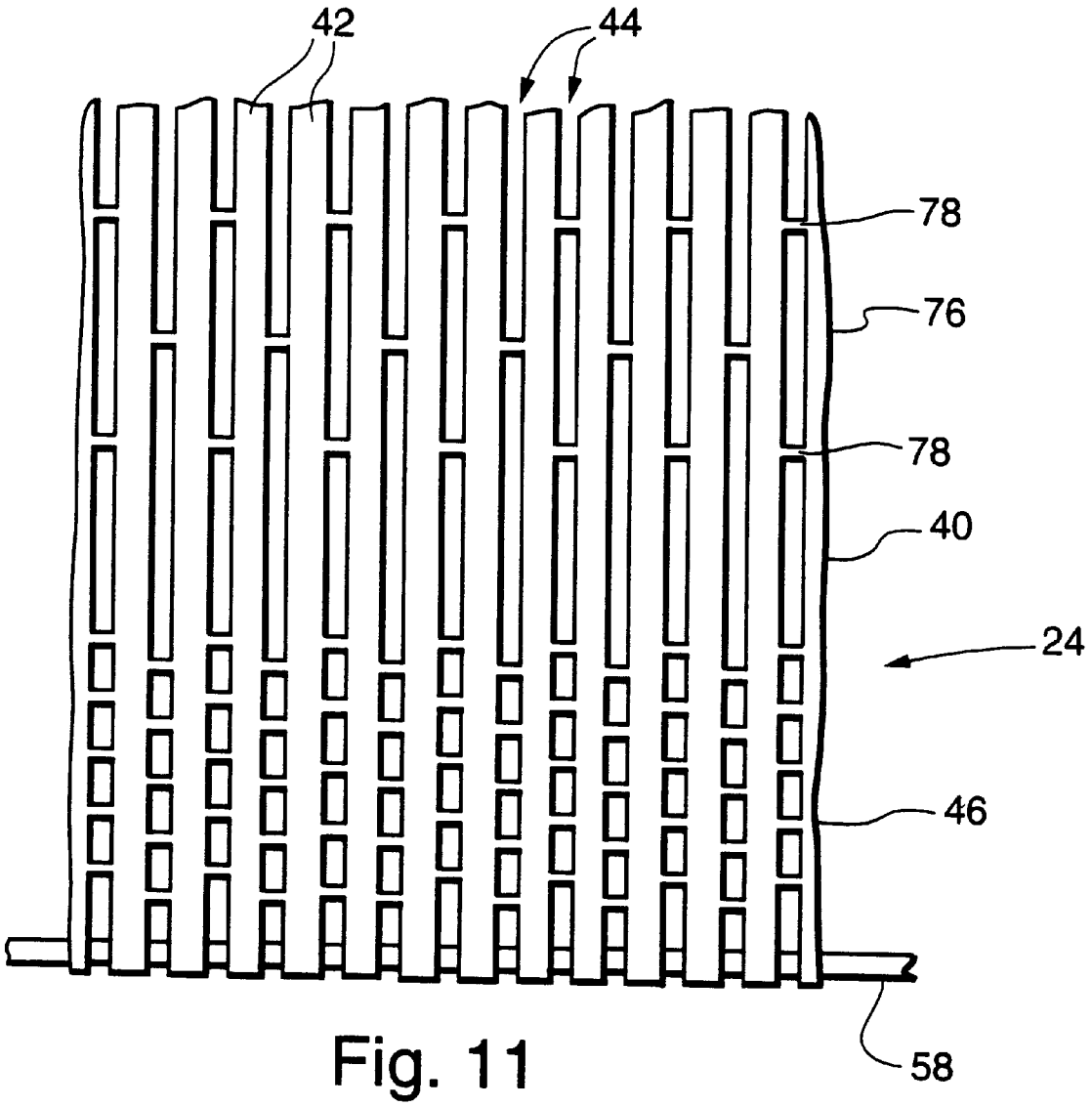

Other embodiments of mask borders having different tie bar patterns are shown in FIGS. 5 through 11. In a mask 64, shown in FIG. 5, tie bars are omitted near the compliant section 58. In a mask 66, shown in FIG. 6, the tie bar positions are repeated every third column instead of every second column, as is done in the pattern of FIG. 3. FIG. 7 shows a mask 68, wherein the spacing between tie bars is increased. FIG. 8 shows a mask 70, wherein the repeat distance between tie bars is varied between adjacent columns. FIG. 9 shows a mask 72, wherein a large tie bar is inserted in every other column. FIG. 10 shows a mask 74, wherein every fourth column includes a large tie bar and the three intermediate columns do not have any tie bars near the compliant section 58. FIG. 11 shows a mask 76 having a border portion similar to that shown in the mask 24 of FIG. 3, but an active portion 40 having widely spaced tie bars 78 connecting the strands therein. Alternatively, the vertical spacing between the tie bars 78 in the active portion 40 could be the same as the vertical spacing between tie bars in the border portion 46. Also possible are additional mask embodiments, which have border portions that include tie bars. Preferably, the centerlines of tie bars in adjacent apertures are vertically offset.

In different embodiments, the vertical spacings between tie bars are in the range of 2.03 mm (80 mils) to as much as 76.96 mm (3030 mils). However, vertical spacings of tie bars of 2.54 mm (100 mils) to 4.06 mm (160 mils) are preferred. Generally, tie bar thickness of about 0.38 mm (15 mils) is preferred, although thicknesses of 1.02 mm (40 mils) are used in some embodiments. Preferably, the mask is made from Invar material that is 0.10 mm (4.0 mils) thick, and the frame is made of AK steel.

All known commercially used tension shadow mask tubes have had solid border portions at the mask-to-frame weld points. This was acceptable when the mask and frame were made from similar expanding materials. However, when a mask and frame differ greatly in coefficients of thermal expansion, such solid border portions will deform, thereby permanently deforming the active portion of the mask during thermal processing of the tube. Individual attachment of the mask strands to the frame, in combination with the novel border portion of the present invention, prevents substantial distortion in the active portion of the mask by providing a "mechanical filter" that accommodates any individual strand attachment error or movement during processing or tube operation.

What is claimed is:

1. In a color picture tube having a tension mask attached to a support frame mounted within said tube, the improvement comprising said mask having a significantly lower coefficient of thermal expansion than that of said frame, said mask having an active apertured portion formed by a plurality of parallel vertically extending strands, between which are elongated apertures through which electron beams pass during operation of said tube, and two opposite side border portions, outside said active apertured portion, having tie bars extending between said vertically extending strands.

2. The color picture tube as defined in claim 1, wherein centerlines of said tie bars within adjacent apertures are vertically staggered.

3. The color picture tube as defined in claim 1, wherein said strands have tie bars therebetween in the active apertured portion of said mask.

4. The color picture tube as defined in claim 3, wherein the vertical spacing between the tie bars in the active apertured portion is greater than the vertical spacing between the tie bars in the border portions.

5. The color picture tube as defined in claim 1, wherein said mask is made from Invar and said frame is made from steel.

6. In a color picture tube having a tension mask attached to a support frame mounted within said tube, the improvement comprising said mask having a significantly lower coefficient of thermal expansion than that of said frame, said mask having an active apertured portion formed by a plurality of parallel vertically extending strands, between which are elongated apertures through which electron beams pass during operation of said tube, two opposite side border portions, outside said active apertured portion, having tie bars extending between said vertically extending strands, and said strands being separated at said frame and being individually welded to said frame.

7. The color picture tube as defined in claim 6, wherein centerlines of said tie bars within adjacent apertures are vertically staggered.

8. The color picture tube as defined in claim 6, wherein said strands have tie bars therebetween in the active apertured portion of said mask.

9. The color picture tube as defined in claim 8, wherein the vertical spacing between the tie bars in the active apertured portion is greater than the vertical spacing between the tie bars in the border portions.

10. The color picture tube as defined in claim 6, wherein said mask is made from Invar and said frame is made from steel.

* * * * *